United States Patent [19]

Schutten

[11] Patent Number: 4,530,317

[45] Date of Patent: Jul. 23, 1985

[54] VARIABLE DISPLACEMENT FREE PISTON ENGINE

[75] Inventor: Herman P. Schutten, Milwaukee, Wis.

[73] Assignee: Eaton Corporation, Cleveland, Ohio

[21] Appl. No.: 602,340

[22] Filed: Apr. 20, 1984

[51] Int. Cl.[3] ..... F02B 71/00

[52] U.S. Cl. ..... 123/46 R; 251/129

[58] Field of Search ..... 123/46; 251/129

[56] References Cited

U.S. PATENT DOCUMENTS

| | | | |
|---|---|---|---|
| 3,194,007 | 7/1965 | Bouvier et al. | 123/46 R |
| 3,714,781 | 2/1973 | Raetiger | 123/46 R |
| 3,998,049 | 12/1976 | McKinley et al. | 123/46 R |
| 4,300,595 | 11/1981 | Mayer et al. | 251/129 |

FOREIGN PATENT DOCUMENTS

| | | | |
|---|---|---|---|
| 465513 | 6/1975 | U.S.S.R. | 251/129 |

*Primary Examiner*—Craig R. Feinberg

*Attorney, Agent, or Firm*—Andrus, Sceales, Starke & Sawall

[57] ABSTRACT

A variable displacement engine (2) includes a free piston (4) reciprocal in a cylinder (6) between a combustion chamber (8) and a fluid filled work chamber (10). The work chamber has a work output port (12) expelling fluid (14) during the power stroke of the piston. A fluid motor (24) is operatively coupled to the work chamber and driven by fluid from the work output port. A valve (28) is selectively actuated during the power stroke of the piston to stop expulsion of fluid from the work output port to the fluid motor to halt movement of the piston, providing variable displacement according to actuation timing of the valve. A control (72) is coupled to the valve and to the fuel supply (16) to the combustion chamber, and the supplied fuel may be matched to the variable length power stroke of the piston.

4 Claims, 4 Drawing Figures

VARIABLE DISPLACEMENT FREE PISTON ENGINE

BACKGROUND AND SUMMARY

The present invention relates to an internal combustion engine of variable displacement.

The variable displacement is accomplished by varying the length of piston stroke, which in turn is accomplished by controllably varying the expulsion of work fluid driven by the piston.

A free piston is reciprocal in a cylinder between a combustion chamber and a fluid filled work chamber. The work chamber has a work output port expelling fluid during a power stroke of the piston. A fluid motor is operatively coupled to the work chamber and is driven by fluid from the work output port. A high speed valve between the work chamber and the fluid motor is selectively actuatable during the power stroke of the piston to stop expulsion of fluid from the work output port to the fluid motor to halt movement of the piston during the power stroke, since the fluid cannot escape. This provides variable displacement of the piston according to the relative timing of valve actuation during the power stroke. The variable length power stroke of the pistion provides a variable displacement of fluid to the fluid motor in proportion thereto. This further facilitates feedback control wherein the fuel supplied to the combustion chamber may be coordinated with the variable length power stroke of the piston as selectively controlled by the high speed valve, to afford a variable displacement engine with matching supplied fuel and power stroke. As the length of the power stroke decreases, the amount of fuel supplied to the combustion chamber may be decreased, and the amount of fluid expelled through the work output port to the fluid motor decreases.

DETAILED DESCRIPTION

Figure 1:
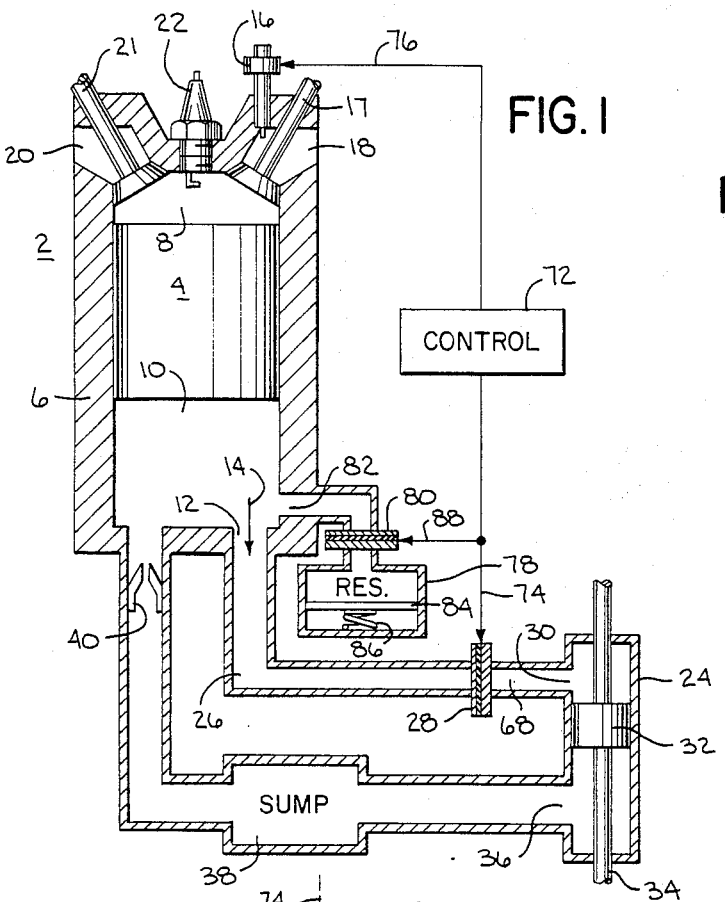
FIG. 1 is a schematic diagram of a variable displacement engine in accordance with the invention.

FIG. 1 shows a variable displacement engine 2. A free piston 4 is reciprocal up-down in a cylinder 6 between a combustion chamber 8 and a fluid filled work chamber 10. The work chamber has a work output port 12 expelling fluid as shown at arrow 14 during a downward power stroke of piston 4. Means such as fuel injector 16, air intake valve 17, and intake port 18, controllably supply fuel to the combustion chamber. The spent combustion products exit through exhaust port 20 having an exhaust valve 21. For spark ignited type engines, spark plug 22 is provided.

A fluid motor 24 is operatively coupled by conduit or passage 26 to work chamber 10 through valve means 28, and is driven by fluid from work output port 12. Valve means 28 is selectively actuatable to stop expulsion of fluid from work output port 12 to fluid motor 24 to halt downward movement of piston 4 during its power stroke. Movement of the piston is halted because the fluid in chamber 10 cannot escape. This provides variable displacement of the piston according to the relative timing of actuation of valve 28 during the power stroke of the piston. The variable length power stroke of the piston provides a variable displacement of fluid to fluid motor 24 in proportion thereto. Valve 28 is between fluid motor 24 and work chamber 10. Valve 28 has an open condition allowing fluid flow therethrough to inlet port 30 of fluid motor 24 to drive the latter, for example driving piston 32 and shaft 34 downwardly. Fluid below piston 32 is expelled leftwardly through outlet port 36 to sump tank 38. Sump 38 is a non-pressurized collection receptacle between fluid motor 24 and work chamber 10. A one-way valve 40, such as a reed valve or the like, is between sump tank 38 and work chamber 10 and permits one-way fluid flow from the former upwardly to the latter, but blocks reverse flow.

Figure 2:
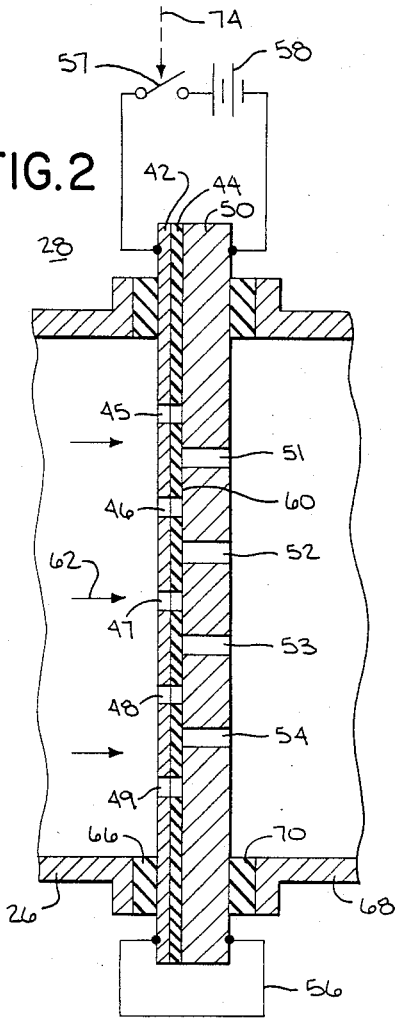
FIG. 2 is a sectional side view of a high speed microporous mechanical valve used in the combination in FIG. 1.
Figure 4:
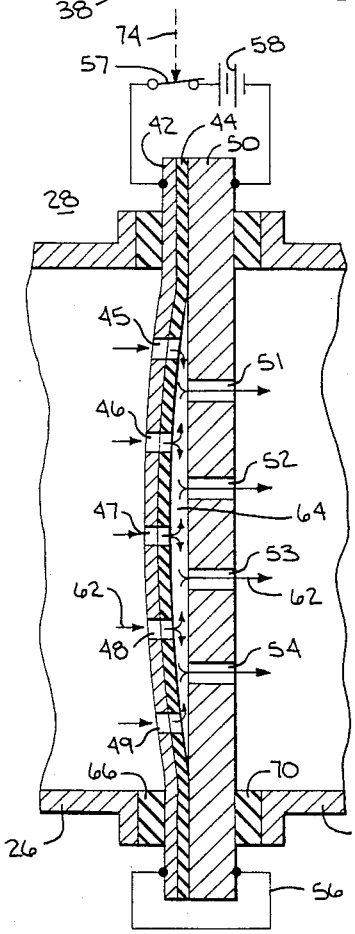
FIG. 4 is a view like FIG. 2, but showing the valve in an open position.
Figure 3:
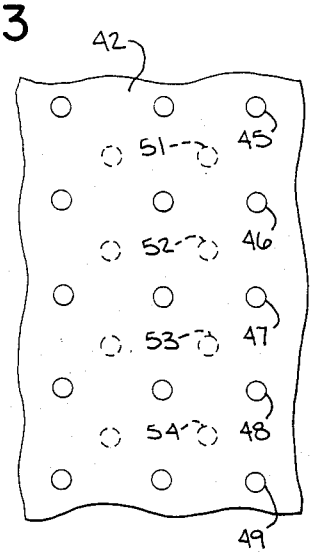
FIG. 3 is a partial left side elevation view of the structure of FIG. 2.

Valve 28 must be extremely fast and may be like that shown in co-pending application Ser. No. 06/602,338, filed Apr. 20, 1984 still pending. FIGS. 2–4 show a microporous, high speed, low mass, mechanical valve affording a macro-opening with micromovement. A fast actuation time enables fluid exit from work chamber 10 to be stopped during the downward power stroke of the piston, to thus halt the latter and controllably vary engine displacement.

A first planar sheet-like electrically conductive microporous film 42 has an electrically insulative face surface 44 on one side thereof, and an array of microapertures such as 45–49 through the film and face surface. A second planar sheet-like electrically conductive microporous film 50 abuts insulative face surface 44 on the opposite side thereof from film 42, and has an array of microapertures such as 51–54 therethrough nonaligned with the first array 45–49, FIGS. 2 and 3.

The bottom end of film 42 is ohmically connected to the bottom end of film 50 by conductor 56. The top end of film 42 is connected through switch 57 to the positive terminal of a voltage source such as battery 58. The top end of film 50 is connected to the negative terminal of battery 58. Electric circuit means 56–58 supplies electric current flow through parallel films 42 and 50 to effect relative transverse movement therebetween due to interacting electromagnetic fields.

FIG. 2 shows valve 28 in the closed position, with films 42 and 50 abutting insulative face surface 44. The interface between the films at surface 44 provides a seal 60 which blocks fluid flow. The fluid, as shown at arrow 62, thus cannot pass rightwardly through the valve.

FIG. 4 shows valve 28 in an open condition, allowing fluid flow therethrough. With switch 57 closed, current flows from the positive terminal of battery 58 to the top of plate 42, then downwardly through plate 42 then through conductor 56 and then upwardly through plate 50 to the negative terminal of battery 58. This current flow in opposite directions through the parallel films drives them transversely apart due to opposing electromagnetic fields, to break interface seal 60 and allow fluid flow passage through the first and second arrays of apertures 45–49 and 51–54 and through the space 64 between the transversely separated films.

In the disclosed embodiment, film 42 is a flexible layer of aluminum with an aluminum oxide face 44. Film 50 is an aluminum or the substrate which is substantially rigid relative to film 42 such that the latter bows leftwardly in the open position of the valve. The valve is actuated from open to closed, or vice versa, within about one hundred microseconds by transverse left-right movement of film 42 through a distance of about one hundred microns, affording a lateral opening area of about one square inch against pressures up to about six hundred pounds per square inch. Conduit 26 is interfaced to left film 42 by annular electrically insulative sealing gasket means 66. Conduit 68 to the fluid motor is interfaced to the right film 50 by annular electrically insulative sealing gasket means 70. In the embodiment shown, valve 28 is actuated to its closed position by opening switch 57. In an alternative, current may be supplied through the films in the same direction to afford electromagnetic fields which cause attraction of the films to a closed position.

When varying the length of the power stroke of the piston, it is also possible to vary the supply of fuel to the combustion chamber to maximize fuel economy and output power. By coordinating the supplied fuel with the variable length power stroke as selectively controlled by valve 28, there is afforded a variable displacement engine with matching supplied fuel and power stroke. In accordance with this method of operation, as the length of the piston power stroke decreases, the amount of fuel supplied to combustion chamber 8 decreases, and the amount of fluid expelled through work output port 12 to fluid motor 24 decreases. In one form, fuel injector 16 includes a valve like valve 28, and control means 72 is coupled to valve 28 and fuel injector 16 for actuating control switches such as 57 as shown at 74 and 76.

The return stroke of piston 4 may be supplied by another piston in tandem which may be in its power stroke, or the like, or by storing some of the energy generated during the power stroke of piston 4 and subsequently releasing such energy to cause a return stroke of piston 4. Energy storage reservoir 78 is connected to work chamber 10 through a valve 80 which is like valve 28. Reservoir 78 may be supplied from work output port 12 at conduit 26, or may have a dedicated output port 82. Valve 80 is opened during the downward power stroke of piston 4 such that fluid enters reservoir 78 to push piston plate 84 downwardly against loading spring 86, to store energy in the latter. The amount of energy stored is controlled by the rating of spring 86 and the length of time that valve 80 is open during the power stroke of piston 4. For the return stroke of piston 4, valve 28 is closed and valve 80 is open such that fluid is forced from reservoir 78 back into work chamber 10 to drive piston 4 upwardly. In this embodiment, control 72 may be coupled to valve 80 for actuating its correspondent switch 57 at 88. Valve 80 in its open condition permits fluid flow between work chamber 10 and reservoir 78 in a direction determined by the highest pressure therebetween.

It is recognized that various modifications are possible within the scope of the appended claims.

I claim:

1. A variable displacement engine, comprising:

a free piston engine reciprocal in a cylinder between a combustion chamber and a fluid filled work chamber, said work chamber having a work output port expelling fluid during a power stroke of said piston;

means for controllably supplying fuel to said combustion chamber;

an exhaust port in said combustion chamber;

a fluid motor operatively coupled to said work chamber and driven by fluid from said work output port;

valve means selectively actuatable to stop expulsion of fluid from said work output port to said fluid motor to halt movement of said piston during said power stroke, providing variable displacement of said piston according to actuation of said valve means; and control means coupled to said valve means and said fuel supply means to coordinate the supplied fuel to the variable length power stroke of said piston as selectively controlled by said valve means, to afford a variable displacement engine with matching supplied fuel and power stroke;

wherein:

said variable length power stroke of said piston provides a variable displacement of fluid to said fluid motor in proportion thereto, such that as the length of said power stroke of said piston decreases, the amount of fuel supplied to said combustion chamber decreases, and the amount of fluid expelled through said work output port to said fluid motor decreases;

said valve means is between said work chamber and said fluid motor, and has a closed position blocking fluid flow from said work chamber to said fluid motor, and has an open position allowing fluid flow from said work chamber to said fluid motor;

said valve means comprises a high speed microporous, low mass, mechanical valve providing a marco-opening with micromovement, comprising:

a first planar sheet-like electrically conductive microporous film having an electrically insulative face surface on one side thereof, and an array of microapertures through said film and face surface;

a second planar sheet-like electrically conductive microporous film abutting said insulative face surface on the opposite side thereof from said first film, and having an array of microapertures through said second film nonaligned with said first mentioned array;

electric circuit means for supplying electric current flow through said first and second films to effect relative transverse movement therebetween due to interacting electromagnetic fields to open passages through said microapertures allowing transverse fluid flow through said films.

2. The invention according to claim 1 wherein:

said valve means is normally closed, with said first and second films abutting said insulative face surface and said first and second arrays nonaligned, the interface between said first and second films at said insulative face surface providing a seal which blocks fluid flow;

said valve means has an open position wherein said electric circuit means passes current through said first and second films in opposite directions to drive them transversely apart due to opposing electromagnetic fields to break said interface seal and allow fluid flow passage through said first and second arrays of microapertures and through the space between said transversely separated films.

3. A variable displacement engine, comprising:

a free piston engine reciprocal in a cylinder between a combustion chamber and a fluid filled work chamber, said work chamber having a work output port expelling fluid during a power stroke of said piston;

means for controllably supplying fuel to said combustion chamber;

an exhaust port in said combustion chamber;

a fluid motor operatively coupled to said work chamber and driven by fluid from said work output port;

valve means selectively actuatable to stop expulsion of fluid from said work output port to said fluid motor to halt movement of said piston during said power stroke, providing variable displacement of said piston according to actuation of said valve means; and control means coupled to said valve means and said fuel supply means to coordinate the supplied fuel to the variable length power stroke of said piston as selectively controlled by said valve means, to afford a variable displacement engine with matching supplied fuel and power stroke;

a sump tank between said fluid motor and said work chamber for receiving fluid from said fluid motor and supplying fluid to said work chamber;

energy storage reservoir means operatively coupled to said work chamber for receiving fluid expelled during said power stroke of said piston and storing a portion of the energy thereof for subsequently driving said piston through a return stroke in the opposite direction of said power stroke;

valve means between said energy storage reservoir means and said work chamber and selectively actuatable to an open condition permitting fluid flow between said work chamber and said reservoir means in a direction determined by the highest pressure therebetween, and a closed position blocking fluid flow therebetween;

wherein:

said variable length power stroke of said piston provides a variable displacement of fluid to said fluid motor in porportion thereto, such that as the length of said power stroke of said piston decreases, the amount of fuel supplied to said combustion chamber decreases, and the amount of fluid expelled through said work output port to said fluid motor decreases;

said first mentioned valve means is between said work chamber and said fluid motor, and has a closed position blocking fluid flow from said work chamber to said fluid motor, and has an open position allowing fluid flow from said work chamber to said fluid motor;

said control means is coupled to said first mentioned valve means, said fuel supplying means and said second mentioned valve means;

each of said first and second valve means comprises a high speed microporous, low mass, mechanical valve providing a macro-opening with a micromovement, comprising:

a first planar sheet-like electrically conductive microporous film having an electrically insulative face surface on one side thereof, and an array of microapertures through said film and face surface;

a second planar sheet-like electrically conductive microporous film abutting said insulative face surface on the opposite side thereof from said first film, and having an array of microapertures through said second film nonaligned with said first mentioned array;

electric current means for supplying electric current flow through said first and second films to effect relative transverse movement therebetween due to interacting electromagnetic fields to open passages through said microapertures allowing transverse fluid flow through said films.

4. A variable displacement engine, comprising:

a free piston engine reciprocal in a cylinder between a combustion chamber and a fluid filled work chamber, said work chamber having a work output port expelling fluid during a power stroke of said piston;

means for controllably supplying fuel to said combustion chamber;

an exhaust port in said combustion chamber;

a fluid motor operatively coupled to said work chamber and driven by fluid from said work output port;

valve means selectively actuatable to stop expulsion of fluid from said work output port to said fluid motor to halt movement of said piston during said power stroke, providing variable displacement of said piston according to actuation of said valve means; and control means coupled to said valve means and said fuel supply means to coordinate the supplied fuel to the variable length power stroke of said piston as selectively controlled by said valve means, to afford a variable displacement engine with matching supplied fuel and power stroke;

wherein said variable length power stroke of said piston provides a variable displacement of fluid to said fluid motor in proportion thereto, such that as the length of said power stroke of said piston decreases, the amount of fuel supplied to said combustion chamber decreases, and the amount of fluid expelled through said work output port to said fluid motor decreases;

wherein said valve means is between said work chamber and said fluid motor, and has a closed position blocking fluid flow from said work chamber to said fluid motor, and has an open position allowing fluid flow from said work chamber to said fluid motor;

and further comprising second valve means in said fuel supply means, and wherein said control means is coupled to both of said first and second valve means, and wherein each of said first and second valve means comprises a high speed microporous, low mass, mechanical valve providing macro-opening with micromovement, comprising:

a first planar sheet-like electrically conductive microporous film having an electrically insulative face surface on one side thereof, and an array of microapertures through said film and face surface;

a second planar sheet-like electrically conductive microporous film abutting said insulative face surface on the opposite side thereof from said first film, and having an array of microapertures through said second film nonaligned with said first mentioned array;

electric circuit means for supplying electric current flow through said first and second films to effect relative transverse movement therebetween due to interacting electromagnetic fields to open passages through said microapertures allowing transverse fluid flow through said films.

* * * * *